United States Patent [19]

Sarich

[11] 4,219,315

[45] Aug. 26, 1980

[54] SEALING MEMBER FOR ORBITAL OR ROTARY MOTORS

[76] Inventor: Tony R. Sarich, 9 Halse Pl., Karrinyup, Australia

[21] Appl. No.: 909,993

[22] Filed: May 25, 1978

[30] Foreign Application Priority Data

May 26, 1977 [AU] Australia ..... PC0239

[51] Int. Cl.[3] ..... F01C 1/00; F01C 19/00; F03C 2/00; F04C 2/00

[52] U.S. Cl. ..... 418/61 R; 418/142; 277/120

[58] Field of Search ..... 418/61 R, 64, 142; 277/84, 93 SD, 119, 120

[56] References Cited

U.S. PATENT DOCUMENTS

| | | | |
|---|---|---|---|
| 1,996,620 | 4/1935 | Ketterer | 418/61 R |
| 3,109,661 | 11/1963 | Swaim et al. | 277/84 |
| 3,368,537 | 2/1968 | Cavallone et al. | 418/61 R |
| 3,919,980 | 11/1975 | Veatch | 418/61 R |
| 3,923,431 | 12/1975 | Abbey | 418/61 R |
| 4,068,986 | 1/1978 | Todorovic | 418/61 R |

*Primary Examiner*—John J. Vrablik

*Attorney, Agent, or Firm*—Wenderoth, Lind & Ponack

[57] ABSTRACT

An orbital engine has a piston member journalled on a shaft within a housing to orbit therein upon rotation of the shaft. A plurality of vanes form with the housing and piston member a plurality of variable volume chambers. An annular sealing member is mounted in a recess in a radial face of the piston member and engages an opposed radial face of the housing to form a seal therebetween. The sealing member has a radial face engaging the radial face of the housing and a non-radial face engaging a wall of the recess in the piston and a resilient member urging the radial and non-radial faces of the sealing member into sealing engagement with the housing and piston member.

6 Claims, 4 Drawing Figures

SEALING MEMBER FOR ORBITAL OR ROTARY MOTORS

BACKGROUND OF THE INVENTION

This invention relates to a sealing member incorporated in an orbital or rotary motor such as an engine, pump, or compressor. The sealing member is incorporated in the engine to provide a seal between the radial end face of the housing and the opposed radial end face of the piston or like member which orbits or rotates within the housing.

In order to allow the orbital or rotary movement of the piston member, within the housing, under a range of temperature and/or pressure conditions, such as may exist in an internal combustion engine, clearance must be provided between the radial end faces of the piston and housing to accommodate differential expansion between the piston member and housing.

Clearance also exists between the radial end faces of the piston member and housing to permit the required orbital or rotary movement therebetween and as a result of manufacturing tolerance.

However for the effective operation of the engine pump or compressor it is inherent that gas or fluid must be prevented from passing between these radial faces by way of the clearance provided, and thus a seal arrangement must be provided which will prevent the leakage of gas or fluids, whilst at the same time not interfering with the relative movement between the piston member and housing.

A large number of known orbital or rotary motors are provided with a number of van members which co-operate with the piston member and housing to form a number of chambers which vary in volume in sequence as the piston member rotates or orbits within the housing. In such motors it is also necessary to provide an effective seal against the passage of gas or fluid from one chamber to the adjacent chamber, between the radial faces of the piston member and housing.

In known engines it is customary to employ an annular sealing ring mounted in a groove in the radial face of the piston member concentric with the axis of the piston member. A spring device is disposed in the base of the groove holding the ring to urge the sealing ring into contact with the radial face of the housing and thus provide the desired seal.

SUMMARY OF THE INVENTION

It is the object of the present invention to provide a seal member that may be incorporated in a rotary or orbital engine pump or compressor between the piston member and housing in order to provide a more effective seal to prevent the passage of gas or fluid therebetween during operation of the motor.

With that object in view there is provided in an orbital or rotary engine pump or compressor comprising a housing having a shaft journalled therein, a piston member within the housing and eccentrically mounted on the shaft for orbital or rotary movement relative to the housing in response to relative rotation between the housing and shaft about the axis of the shaft, and a plurality of vanes in co-operating relation with the housing and piston member to define therewith a plurality of chambers that vary in volume in response to the orbital or rotary movement, the housing and piston member having opposed faces in respective radial planes. An annular sealing member is mounted in a recess in the radial face of the piston member and engages the radial face of the housing to form a seal between such radial faces. The sealing member has a radial face engaging the radial face of the housing, a non-radial face engaging a wall of the recess in the piston member, and a third face inclined to the first and second faces. Means, such as fluid pressure from an adjacent work chamber, act on the sealing member to urge the radial and non-radial faces of the sealing member in sealing engagement with the housing and piston member.

Throughout this specification including the preceding paragraph the term "radial plane" means a plane which is radial with respect to the axis of the shaft and is transverse to the longitudinal axis of the shaft. Likewise the term "radial face" means a face located in a radial plane.

Preferably the non-radial face of the sealing member is normal to the radial face. Further the means acting on the sealing member to hold the faces in sealing engagement with the mating components preferably has a line of action passing through the intersection of the radial and non-radial faces of the sealing member. It will be appreciated that as the sealing member is of an annular form the radial face will also be of an annular form whilst the non-radial face, which is at an angle to the radial face, preferably normal, would be in the form of a peripheral surface on the sealing member, preferably an internal peripheral surface.

In a preferred form the sealing member has a generally triangular cross section with the non-radial face at right angles to the radial face. A spring element may be interposed between a portion of the groove and the remaining or third face of the triangular shaped sealing member so that the force applied by the spring will urge both the radial and non-radial faces of the sealing member into engagement with the mating faces of the housing and piston member respectively.

It will be appreciated that in the construction of the sealing member, as herein previously described, the sealing member acts in the manner of a wedge to maintain the radial and non-radial faces thereof in contact with the mating faces of the housing and piston member. This wedging action may of course be achieved with a variety of cross sections of sealing member, however the triangular cross section is the simplest form from a point of view of production and assembly.

As previously referred to, it is inherent that clearance in the axial direction exist between the opposed radial faces of the piston member and housing. Accordingly the working fluid in the respective chambers is present in this clearance area and transmits the pressure of the working fluid to the sealing member and sealing elements. The working fluid is applied to the inclined face of the sealing member and the force resulting from this pressure will contribute to the sealing pressure on both the radial and non-radial faces.

This is, the triangular cross-sectioned sealing member will have the working fluid pressure applied to the face of the sealing member inclined to both the radial and non-radial faces. The force resulting from pressure on such inclined face will contribute to the sealing pressure on both the radial and non-radial faces.

In some constructions of orbital motors, such as that disclosed in my U.S. Pat. No. 3,787,150, the ends of the vanes are guided in grooves in the radial faces provided by the end walls of the housing, and are connected to the piston member to reciprocate in such grooves as the piston member orbits. In this construction the vanes are provided with end leg portions which extend radially inward from the periphery of the piston member across the radial face of the annular seal member. Accordingly it is necessary for provision to be made to seal between the piston member and the leg portions of the vane, in that area between the outer peripheral surface of the piston member and the annular sealing member carried by the piston member.

There is thus provided in a preferred form of the present invention, an orbital or rotary motor as previously defined having vanes which extend inwardly from the periphery of the piston member across the radial face of the sealing member, and at least one seal element mounted in the piston member and having a radial face sealably engaging the vane extension. The sealing element or a number of the sealing elements are dimensioned and circumferentially spaced so that throughout the extent of movement of the vane relative to the piston member, during operation of the motor, the radial face of at least one of the seal elements is in sealing engagement with the vane. It is preferable that there are provided a number of seal elements along the extent of travel of the vane relative to the piston member, each of the elements being individually supported in the piston member so that they may move independently to maintain the correct sealing engagement with the vane. Suitable means such as a spring is provided to urge the seal element into sealing engagement with the vane.

Conveniently each seal element is located in a groove in the piston member communicating with the rear of the groove carrying the annular sealing member, when viewed from the radial end face of the piston member. The sealing element when located in the groove will have the radial face of the seal element substantially coplanar with the radial face of the annular sealing member, so that both these radial faces may contact the end wall of the housing and the vane extension respectively, in a substantially common plane. Also the other end of the seal element will be substantially coplanar with the non-radial face of the sealing member, and be in sealing engagement with an extension of the surface of the groove in the piston member with which the non-radial face of the sealing member co-operates.

In an embodiment where the annular sealing member is of substantially triangular cross section the seal element or elements may abut the third side of the triangle. A spring member may be provided between the seal element and the base of the groove in which it is located. The spring element thereby holding the seal element in the correct sealing relation with the co-operating components and also applying a force to the sealing member to maintain it in required sealing engagement with the piston member and housing.

The extension of the vane may be provided with an insert of the construction defined in my U.S. Pat. No. 3,938,916, and the radial face of the seal element engages such insert so that an effective seal is established, which will not be adversely affected by the movement of the vane extension in the axial direction of the shaft, as a result of thermal expansion and contraction of the vane and housing.

In the above description the seal elements are contemplated as being separate components from the sealing member which have abutting faces when in assembly in the piston member. However, it is to be understood that the separate nature of the sealing member and seal element is not an essential aspect, and the sealing elements may be made as an integral part of the sealing member. However, in an integral construction close working tolerances must be maintained to ensure that when the sealing member is located in the annular groove in the piston member each of the integral sealing elements will correctly align with the respective slots provided in the piston member to receive the seal elements.

BRIEF DESCRIPTION OF THE DRAWINGS

The invention will be more readily understood from the following description of one practical arrangement of an engine incorporating seal construction as illustrated in the accompanying drawings wherein.

DETAILED DESCRIPTION OF THE INVENTION

Figure 1:
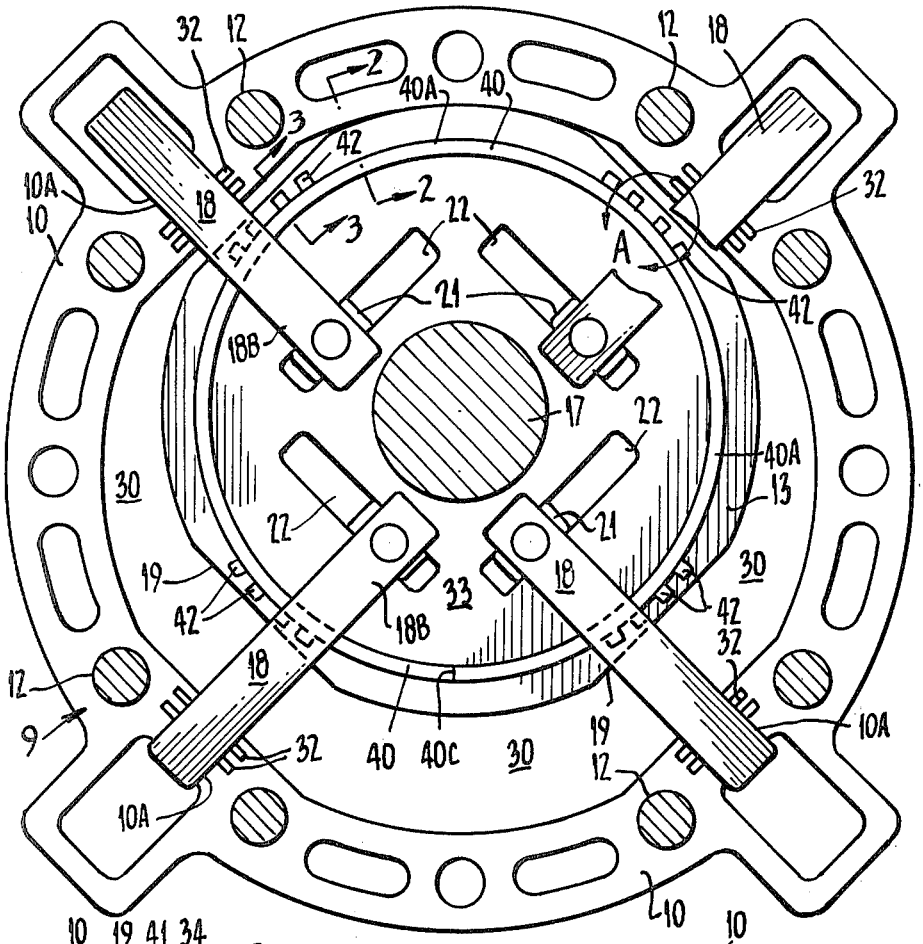
FIG. 1 is a side view of a four chamber orbital engine with one end wall of the housing removed.
Figure 2:
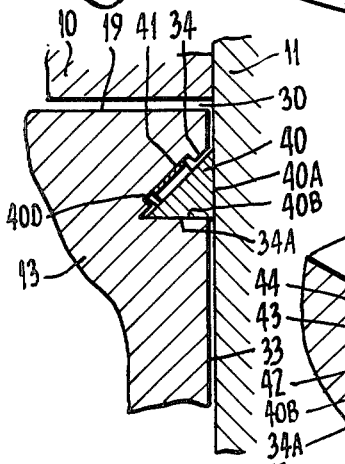
FIG. 2 is a fragmentary section view of the piston and the sealing member in a region between the sealing elements, along the line 2—2 in FIG. 1.
Figure 4:
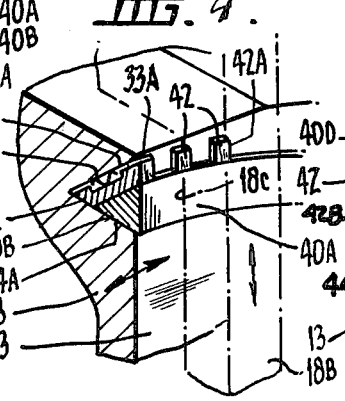
FIG. 4 is an enlarged perspective view of the portion of the piston member indicated at A in FIG. 1.
Figure 3:
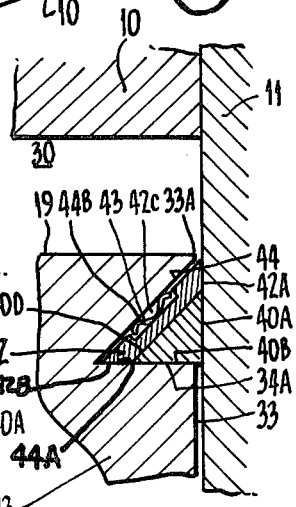
FIG. 3 shows a fragmenting section view of the piston and the sealing member at a region where a sealing element is located, along the line 3—3 in FIG. 1.

The engine comprises a housing 9 having an outer peripheral casing 10 and opposed end plates 11, attached by bolts in holes 12 to the outer casing 10. Bearings (not shown) mounted in respective end plates of the engine rotatably support the crankshaft 17 for rotation about the axis of the outer casing 10. A piston member 13 is rotatably mounted on an eccentric journal of the crankshaft. The space, between the piston member 13 and the casing 10 is divided into a number of chambers 30 by the provision of vanes 18 which are slidably supported in respective slots 10A in the outer casing 10.

The vanes 18 consist of a central portion or vane body which at their inner end abuts respective flat faces 19 on the periphery of the piston member, and two end portions or vane legs 18B, which extend inward beyond the periphery of piston member 13 and have actuating lugs 21 pinned therethrough, and engaging actuating slots 22 in the end radial faces 33 of piston member 13. This arrangement allows vanes 18 to reciprocate radially in the slots 10A in the outer casing 10, and allows piston member 13 to move relative to the vanes in a direction at right angles to the direction of reciprocation of vanes 18 and at right angles to the crankshaft axis.

Seals are provided between all moving parts to prevent the escape of working fluid from the variable volume chambers 30 formed by outer casing 10, end plates 11, piston member 13 and vanes 18. Thus, for example seals 32 are provided in casing 10 to seal against vanes 18.

The seal, which forms a seal between the radial end faces 33 of the piston member and the opposite face of the end wall 11 of the housing and vane legs 18B consists of triangular cross section sealing ring 40 and springs 41 together with sealing elements 42 and springs 43.

When the piston moves in its orbital path, the radial face 40A of the ring 40 is in sliding contact with the housing end wall 11 and the inwardly direct radial face 18C of the vane legs 18B which are located in substantially the same radial plane, and provides the primary seal.

The non-radial face 40B of the triangular section ring 40 is disposed at about a right angle to the radial face 40A, and contacts the non-radial face 34A of the grooves 34 in the piston member 13 to provide the secondary seal. Ring 40 is cut at one point 40C to provide a small ring gap so that a small dimensional mismatch between the non-radial face 40B of ring 40 and the face 34A of the piston groove 34, due to manufacturing tolerances or thermal distortions during operation, will not result in a loss of sealing contact between the secondary sealing face of ring 40 and piston member 13.

The inclined face 40D of the triangular cross section ring 40 is engaged by springs 41 located in the groove 34, to urge ring 40 against both radial and non-radial sealing faces.

As previously referred to leakage between adjoining chambers 30 may occur between the vane leg 18B and the opposite portion 33A of the radial face 33 of the piston member located between the sealing ring 40 and the peripheral face of the piston member. This leakage is controlled to an acceptable level by the four sealing elements 42. The sealing elements 42 are spaced in the direction of movement of the vane leg 18B along the piston member 13 such that at any point in the movement of the vane leg at least two sealing elements 42 are in engagement with the vane leg.

Each sealing element 42 is located in a slot 44 in the piston member, extending from the portion 33A of the radial face 33 of the piston member, across the groove 34 at an angle equal to the inclination of the face 40D of the sealing ring 40. The sealing elements thus engage the inclined face 40D of the sealing ring.

The radial face 42A of each sealing element in turn engages the vane leg 18B as it moves in response to the orbital movement of the piston. The non-radial face 42B of each sealing element engages the extension 44A of the non-radial face 34A of the sealing ring groove 34. The spring 43 is located in the recess 42C of the sealing element and is compressed therein against the rear face 44B of the slot 44. This spring 43 establishes a pressure contact between the radial and non-radial faces 42A and 42B of the sealing element and the vane leg 18B and piston member 13 respectively.

The working fluid in the chambers 30 will enter the groove 34 and slots 44, particularly during the high pressure portion of the pressure cycle of the respective chambers. The pressure of the working fluid acting on the sealing ring 40 and sealing elements 42 assists in establishing the pressure sealing contact between the components.

The sealing faces of the seal elements may conveniently be coated with a material which will allow some controlled wear to occur without scoring or scuffing when the engine is first operated, so that the seal element may rapidly establish good contact with sealing ring 40, piston member 13 and vane legs 18B to prevent gas from lacing from one chamber at high pressure to another at low pressure, either along the back face of sealing ring 40 or between the side of piston member 13 and vane legs 18B.

A similar coating may be used on the radial and non-radial faces of sealing ring 40. In addition, the angle between the radial and non-radial faces 40A and 40B of the sealing ring 40 may be made slightly greater than the angle between the corresponding surfaces of groove 34 and end plate 11. This will cause sealing ring 40 to contact end plate 11 preferentially at the radially outward periphery resulting in increased pressure on that part of the ring and rapid bedding in.

The drawing of the engine in FIG. 1 is simplified for clarity, and it will be appreciated that for the engine to be operational it would be necessary to provide additional components such as inlet and exhaust valves or ports with a suitable timing mechanism to ensure taking in of air-fuel mixture, compressing the mixture, ignition and burning of the fuel thus raising the pressure and producing power and finally exhausting the spent gases together, with means for ignition, lubrication and cooling of the engine. These requirements may be met in a variety of ways obvious to those skilled in the art. One way in which this can be achieved is described in U.S. Pat. No. 3,787,150.

I claim:

1. An orbital or rotary engine or pump comprising:

a housing having a shaft journalled therein;

a piston member within said housing and eccentrically mounted on said shaft for orbital movement relative to said housing in response to relative rotation between said housing and said shaft about the axis of said shaft;

a plurality of vanes in cooperating relation with said housing and said piston member to define therebetween a plurality of work chambers that vary in volume in response to said orbital movement;

said housing and said piston member having opposed radial faces in respective radial planes;

an annular sealing member mounted in a recess in said radial face of said piston member and engaging said radial face of said housing to form a seal between said radial faces;

said sealing member having a radial first face engaging said radial face of said housing, a non-radial second face engaging a radially inner wall of said recess in said piston member and a third face inclined with respect to both said first and second faces;

each said vane having a vane leg extending radially inward from the periphery of said piston member, said vane leg having a radial face directed towards said radial face of said piston member and engaging said sealing member;

a plurality of seal elements mounted in at least one recess in said radial face of said piston member between the periphery of said piston member and said sealing member;

each said seal element having a radial first face to engage said radial face of said vane leg, a non-radial second face engaging said piston member and a third face inclined with respect to both said first and second faces of said seal element;

means acting on said third face of each said seal element for urging said first and second faces of said seal element into engagement with said vane leg and said piston member, respectively; and said seal elements being circumferentially spaced so that the said radial face of each said vane leg is in engagement with the said radial face of at least one of the seal elements throughout the orbital movement of said piston member.

2. An engine or pump as claimed in claim 1, wherein said third face of the said sealing member is disposed within said sealing member recess and defines therewith a space subjected to fluid pressure present in an adjacent of said work chambers, whereby said fluid pressure applied to said inclined third face of said sealing member urges said radial and non-radial faces of said sealing member into sealing engagement with said housing and said piston member, respectively.

3. An engine or pump as claimed in claim 2, wherein said inclined third face of each said seal element defines with said recess in which said seal element is located a space subjected to said fluid pressure present in said adjacent work chamber, whereby said fluid pressure applied to said inclined third face of said seal element urges said radial and non-radial faces of said seal element into engagement with said vane leg and said piston member, respectively.

4. An engine or pump as claimed in claims 2 or 3, wherein a face opposite said third face of each said seal element engages said third face of said sealing member.

5. An engine or pump as claimed in claims 1 or 3, wherein the inclination of said third face of said sealing member is selected so that the line of action of the force applied thereto by said fluid pressure passes substantially through the intersection of said radial and non-radial faces of said sealing member.

6. An engine or pump as claimed in claim 5, wherein said radial and non-radial faces of said seal elements form extensions of said radial and non-radial faces of said sealing member, respectively.

* * * * *